US011148186B2

(12) United States Patent
Masuyama

(10) Patent No.: US 11,148,186 B2
(45) Date of Patent: Oct. 19, 2021

(54) METHOD OF MANUFACTURING CUP STRUCTURE

(71) Applicant: MATEC CO., LTD., Nagoya (JP)

(72) Inventor: Takehiko Masuyama, Nagoya (JP)

(73) Assignee: MATEC CO., LTD., Aichi (JP)

( * ) Notice: Subject to any disclaimer, the term of this patent is extended or adjusted under 35 U.S.C. 154(b) by 200 days.

(21) Appl. No.: 16/092,470

(22) PCT Filed: Mar. 26, 2018

(86) PCT No.: PCT/JP2018/012022
§ 371 (c)(1),
(2) Date: Oct. 10, 2018

(87) PCT Pub. No.: WO2018/186214
PCT Pub. Date: Oct. 11, 2018

(65) Prior Publication Data

US 2019/0160511 A1 May 30, 2019

(30) Foreign Application Priority Data

Apr. 3, 2017 (JP) ..... JP2017-073351

(51) Int. Cl.
*B21D 22/08* (2006.01)
*B21J 5/06* (2006.01)
(Continued)

(52) U.S. Cl.
CPC ..... *B21D 22/28* (2013.01); *B21D 51/10* (2013.01); *B21J 5/02* (2013.01); *B21J 5/06* (2013.01);
(Continued)

(58) Field of Classification Search
CPC ..... B21D 22/28; B21D 51/10; B21J 13/02; B21J 13/14; B21J 5/12; B21J 5/02; B21J 5/06; B21K 21/04
See application file for complete search history.

(56) References Cited

U.S. PATENT DOCUMENTS 3,706,118 A * 12/1972 Hilton ..... B21C 23/20 86/19.5
3,977,225 A * 8/1976 Couchman ..... B21C 23/14 72/265
(Continued)

FOREIGN PATENT DOCUMENTS

CN 205732768 U * 11/2016
CN 205732768 U 11/2016
(Continued)

OTHER PUBLICATIONS

English translate (JPS6422434A), retrieved date May 5, 2020.*
(Continued)

*Primary Examiner* — Adam J Eiseman
*Assistant Examiner* — Mohammed S. Alawadi
(74) *Attorney, Agent, or Firm* — Keating & Bennett, LLP

(57) ABSTRACT

A forging press apparatus includes: a die with a die hole into which a material is to be contained and a relief hole smaller in diameter than the die hole; a molding punch configured to press an inner portion inside a peripheral portion of the material contained in the die hole; and a pressing member provided around an outer periphery of the molding punch to press the peripheral portion. A method includes: loading the material into the die; and forging the cup structure shaped by pressing the inner portion inside the peripheral portion of the material with the molding punch to cause the peripheral portion of the material to be brought into contact with the pressing member, and a part of the material to be pushed out
(Continued)

into the relief hole by the molding punch to form a projection while a space is secured below the projection.

12 Claims, 8 Drawing Sheets

(51) Int. Cl.

| | |
|---|---|
| ***B21J 5/02*** | (2006.01) |
| ***B21J 13/14*** | (2006.01) |
| ***B21K 21/04*** | (2006.01) |
| ***B21J 5/12*** | (2006.01) |
| ***B21J 13/02*** | (2006.01) |
| ***B21D 51/10*** | (2006.01) |
| ***B21D 22/28*** | (2006.01) |

(52) U.S. Cl.
CPC ..... *B21J 5/12* (2013.01); *B21J 13/02* (2013.01); *B21J 13/14* (2013.01); *B21K 21/04* (2013.01)

(56) References Cited

U.S. PATENT DOCUMENTS

| | | | | |
|---|---|---|---|---|
| 5,590,558 | A * | 1/1997 | Saunders | B21D 22/201 72/346 |
| 6,035,688 | A * | 3/2000 | Nagao | B21J 5/02 72/342.3 |
| 6,507,999 | B1 * | 1/2003 | Kaibyshev | B21J 5/02 29/888.042 |
| 9,003,856 | B2 * | 4/2015 | Masuyama | B21K 23/04 72/324 |
| 2003/0213277 | A1 * | 11/2003 | Nagao | B21J 13/14 72/354.8 |
| 2005/0115296 | A1 * | 6/2005 | Sato | B21K 1/762 72/354.8 |
| 2007/0006628 | A1 * | 1/2007 | Tabei | B21K 1/30 72/348 |
| 2009/0255316 | A1 * | 10/2009 | Murata | B21J 5/02 72/345 |
| 2011/0016944 | A1 * | 1/2011 | Tamai | B21J 5/12 72/358 |
| 2014/0069161 | A1 * | 3/2014 | Masuyama | B21K 23/04 72/324 |
| 2015/0063737 | A1 * | 3/2015 | Keppler-Ott | B21J 5/025 384/569 |
| 2016/0354835 | A1 * | 12/2016 | Miyashita | B21J 9/20 |
| 2017/0122378 | A1 * | 5/2017 | Natsume | B21J 1/06 |
| 2018/0214932 | A1 * | 8/2018 | Kohno | B21J 9/12 |

FOREIGN PATENT DOCUMENTS

| | | | | |
|---|---|---|---|---|
| JP | 64-022434 | A | | 1/1989 |
| JP | S6422434 | A | * | 1/1989 |
| JP | 02-251333 | A | | 10/1990 |
| JP | 08-90140 | A | | 4/1996 |
| JP | 2006-007260 | A | | 1/2006 |
| JP | 2006007260 | A | * | 1/2006 |
| JP | 2014-27516 | A | | 2/2014 |
| JP | 2014-087827 | A | | 5/2014 |
| JP | 2014-223644 | A | | 12/2014 |
| JP | 6255205 | B2 | * | 12/2017 |

OTHER PUBLICATIONS

English translate (JP2006007260A), retrieved date May 5, 2020.*
Englis translate (CN205732768U), retrieved date May 5, 2020.*
English translate (JP6255205B2), retrieved date Feb. 18, 2021.*
Official Communication issued in International Patent Application No. PCT/JP2018/012022, dated Jun. 19, 2018.
Official Communication issued in corresponding Chinese Patent Application No. 201810291076.2, dated Jun. 21, 2019.

* cited by examiner

METHOD OF MANUFACTURING CUP STRUCTURE

TECHNICAL FIELD

The present description discloses a technique related to a method of manufacturing a cup structure by forging.

BACKGROUND ART

Heretofore, there is known a bottomed cylindrical case made of aluminum material or the like, as disclosed in Japanese Patent Application Laid-Open No. 2014-27516 (hereinafter referred to as Patent Document 1). The bottomed cylindrical case is formed in a cylindrical shape as a whole, and provided in its side surface with two openings. This kind of bottomed cylindrical case is typically formed by cutting.

RELATED ART DOCUMENT

Patent Document

Patent Document 1: Japanese Patent Application Laid-Open No. 2014-27516

DISCLOSURE OF THE PRESENT INVENTION

Problem to be Solved by the Invention

The bottomed cylindrical case as described above is an example of a cup structure. When a cup structure is formed by forging, material is loaded into a die, and then the material is pressed by a punch to form the cup structure. Unfortunately, the material pressed into the die by the punch loses a place for escape in a closed space, so that a part of the material may enter a clearance between the die and a sleeve to cause flash. In addition, an odd-shaped part such as a cup structure is less likely to be evenly subjected to pressure from the punch. Thus, general pressure is set based on a place that is least likely to be subjected to pressure to cause a void in an end surface, so that the general pressure is likely to increase to cause flash to easily occur. As described above, it cannot be said that manufacturing of a cup structure by forging is easy.

Means for Solving the Problem

The present description discloses a method of manufacturing a cup structure by a forging press apparatus including: a die provided with a die hole into which a material is to be contained, the material serving as a starting material of the cup structure in a bottomed cylindrical shape, and a relief hole smaller in diameter than the die hole extending downward from the die hole; a molding punch configured to press an inner portion inside a peripheral portion of the material contained in the die hole; and a pressing member provided around an outer periphery of the molding punch to press the peripheral portion of the material, the method including the steps of: loading the material into the die; and forging the cup structure shaped by pressing the inner portion inside the peripheral portion of the material with the molding punch to cause the peripheral portion of the material to be brought into contact with the pressing member, and a part of the material to be pushed out into the relief hole by the molding punch to form a projection while a space is secured below the projection.

This method causes the material not only to be pressed by the molding punch but also to be brought into contact with the pressing member in the step of forging, so that the peripheral portion of the material can be reliably pressed down by the pressing member, thereby enabling the cup structure to be prevented from causing flash in its peripheral portion after shaping with the molding punch. In addition, while a part of the material is pushed out into the relief hole by the molding punch to form a projection, a space is secured below the projection. As a result, even when general pressure is set high, occurrence of flash due to losing of a place for escape of the material can be prevented.

The method of manufacturing a cup structure, disclosed in the present description, may be configured as follows.

The die hole may have an opening provided by boring the die, and an end surface of the material may be exposed to an outside through the opening of the die hole.

The molding punch may include a facing end surface facing the end surface of the material, and the facing end surface may press the inner portion inside the peripheral portion in the end surface of the material.

The molding punch may be configured to press the inner portion inside the peripheral portion in the end surface of the material, the pressing member may be configured to be brought into contact with the peripheral portion in the end surface of the material, and the pressing by the molding punch and the contact by the pressing member may be performed at the same time.

The forging press apparatus may include a knock-out pin that is inserted into the relief hole of the die from a distal side, and the space may be secured between a distal end of the projection and an end surface of the knock-out pin in the step of forging.

This enables a hole for inserting the knock-out pin to be used as a relief hole, so that occurrence of flash can be prevented without a significant change in an existing die. It is a matter of course that the cup structure can be removed from the die by using the knock-out pin in a step of removing.

The pressing member may be inserted into the die hole to press the peripheral portion in the end surface of the material in the step of forging.

The structure described above enables the peripheral portion of the material to be shaped by the pressing member and the die.

The method may further include the step of removing the cup structure from the molding punch by causing the pressing member to push out a peripheral portion of the cup structure.

Advantageous Effect of the Invention

The method of manufacturing a cup structure disclosed in the present description enables a cup structure to be manufactured by forging while securing flatness of an end surface to be pressed of a peripheral portion of a material and preventing occurrence of flash.

MODE FOR CARRYING OUT THE INVENTION

Embodiment

Figure 1:
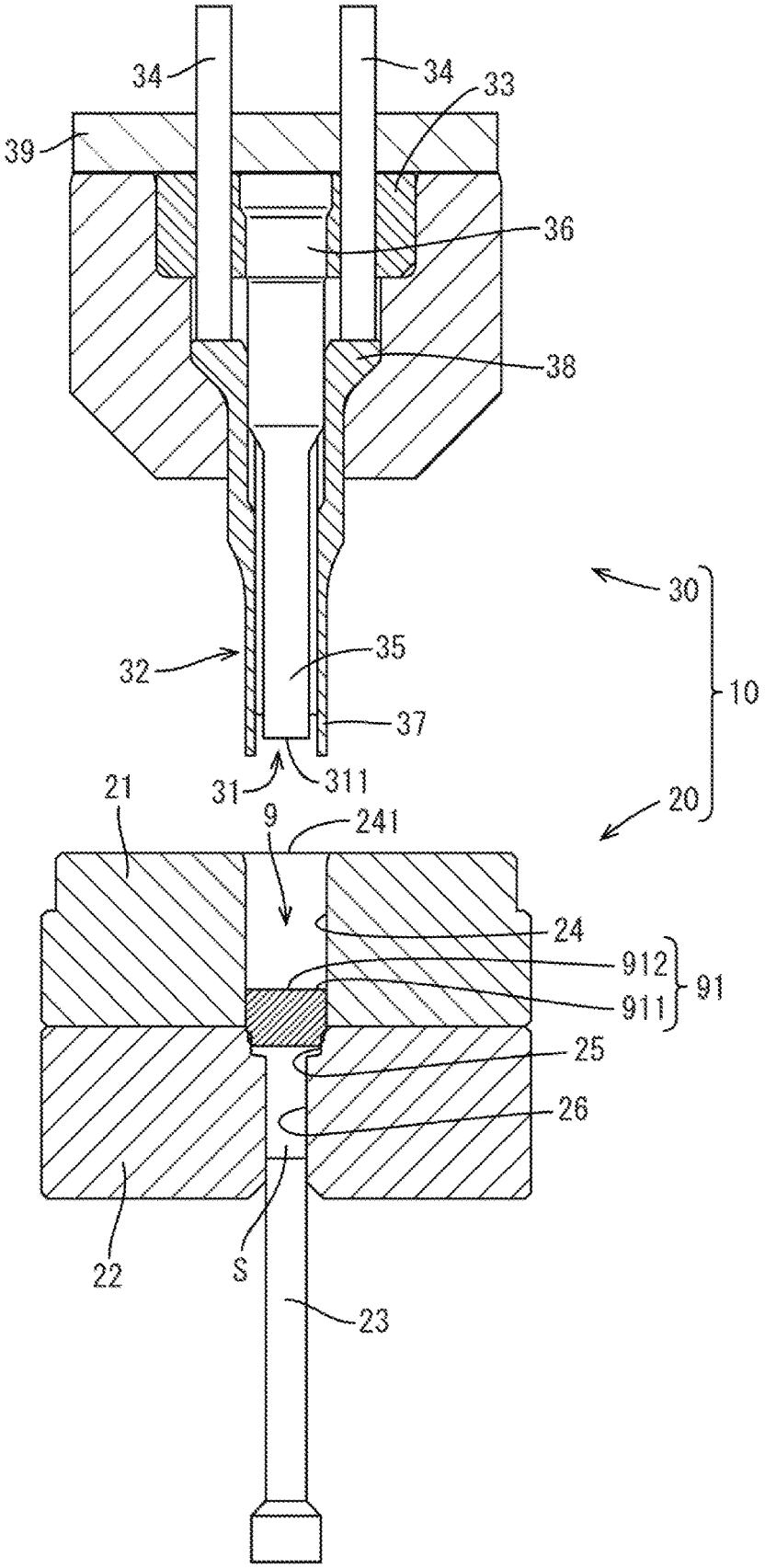
FIG. 1 is a sectional view illustrating a step of loading.
Figure 5:
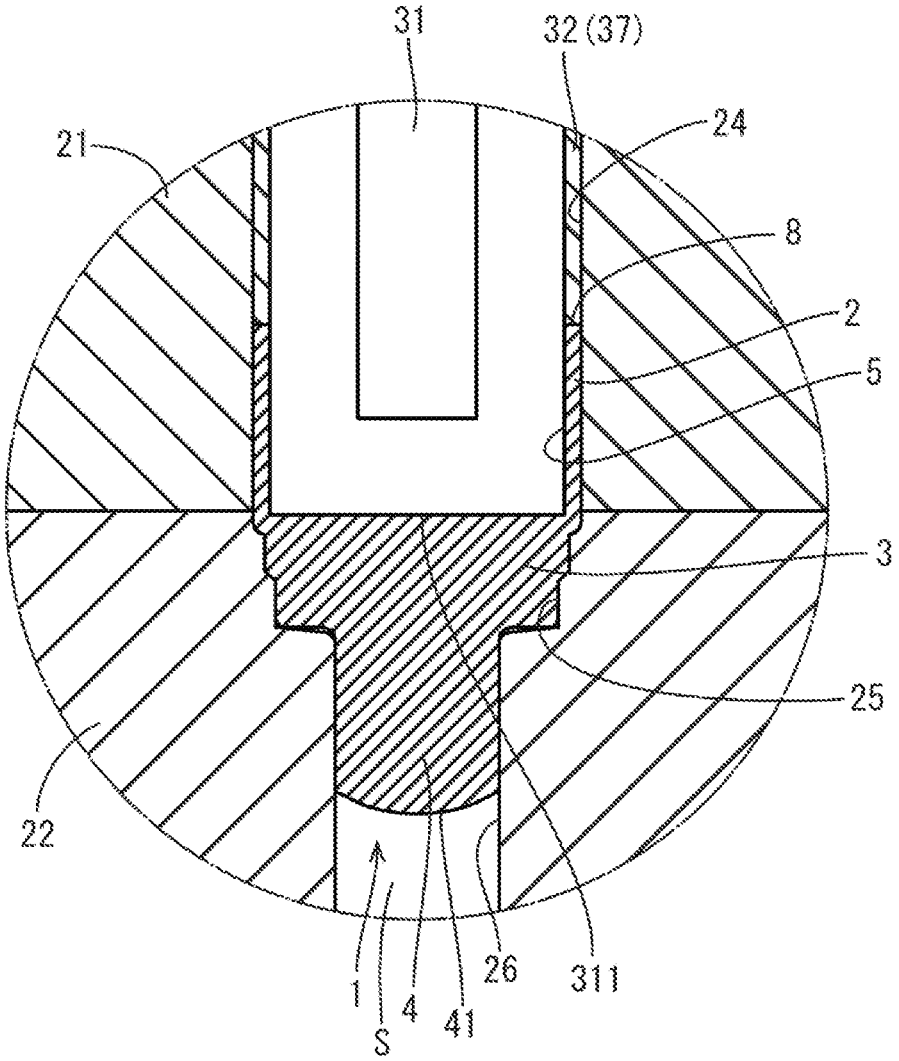
FIG. 5 is an enlarged sectional view illustrating a part of FIG. 4 in an enlarged manner.
Figure 6:
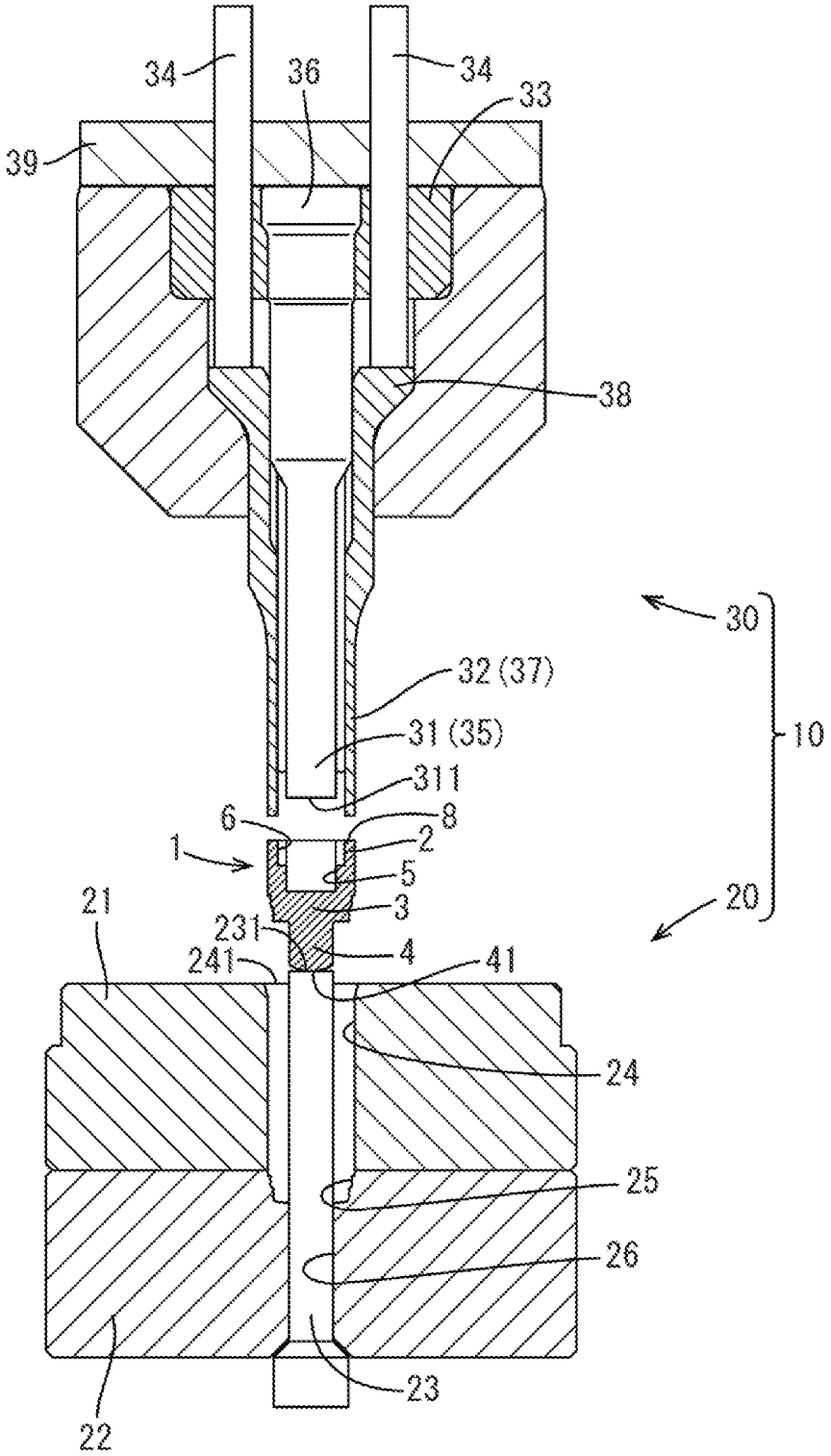
FIG. 6 is a sectional view illustrating a step of removing.
Figure 7:
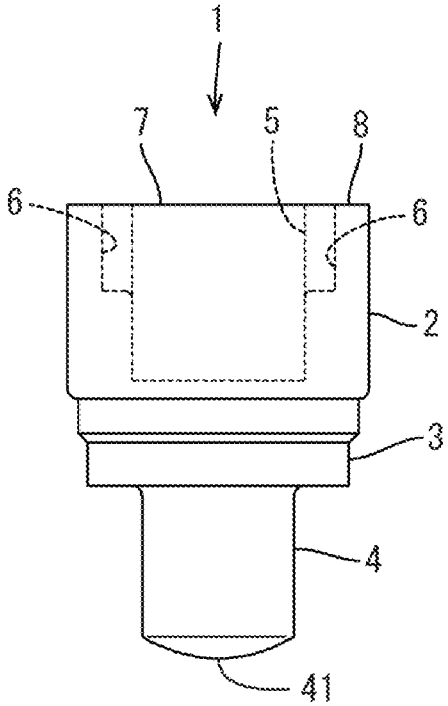
FIG. 7 is a front view of an odd-shaped part.

An embodiment will be described with reference to FIGS. 1 to 10. An odd-shaped part 1 manufactured in the present embodiment is a cup-shaped case for an ultrasonic sensor used for a distance measuring sensor for an automobile, for example. The odd-shaped part 1 includes a cylindrical portion 2 formed in a cylindrical shape and opening upward, a stepped portion 3 provided at a lower end of the cylindrical portion 2, and a projection 4 projecting downward from a lower end of the stepped portion 3, as illustrated in FIG. 7. The odd-shaped part 1 illustrated in FIG. 7 is an intermediate product, and is ultimately formed into an odd-shaped part 1A in a cup-like shape illustrated in FIG. 10 by cutting away a lower portion of the cylindrical portion 2. Meanwhile, a material 9 serving as a starting material of the odd-shaped part 1 is a solid body (a lump without a through-hole) in the shape of a cylindrical column made of an aluminum alloy of heat treatment material, as illustrated in FIG. 1. The material 9 has upper and lower surfaces each of which is not necessarily in the shape of a plane, and may be in any shape.

Figure 8:
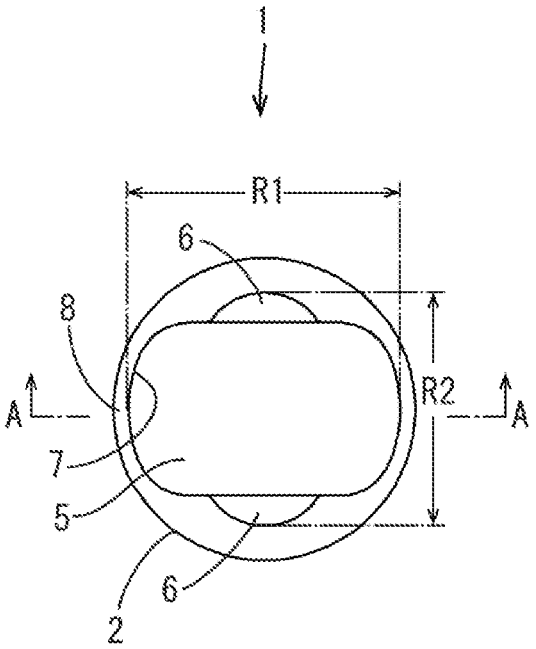
FIG. 8 is a plan view of the odd-shaped part.
Figure 9:
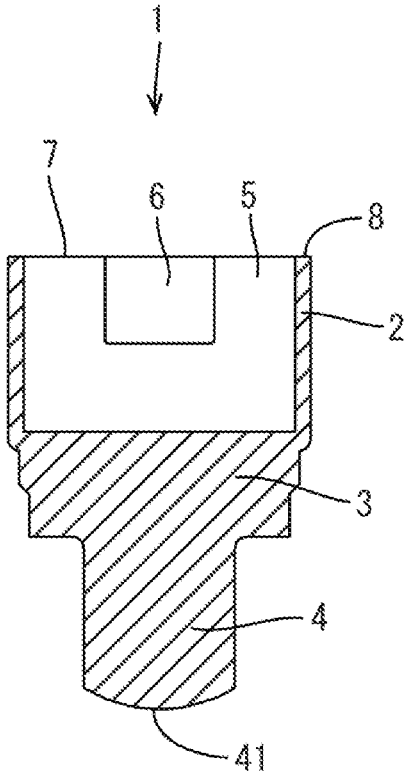
FIG. 9 is a sectional view taken along line A-A in FIG. 8.

The cylindrical portion 2 is provided, in its inside, with a bottomed recess 5 in a horizontally long, substantially oval shape, as illustrated in FIG. 8. The recess 5 is in a flat shape shorter in a longitudinal direction than a lateral direction in a plan view. The recess 5 has cutout portions 6 recessed at respective positions in its inner wall, facing each other in the longitudinal direction, the cutout portions 6 each being cut out in an arc-shape. Each of the cutout portions 6 is provided so as to open upward while facing an opening 7 of the recess 5, as illustrated in FIG. 9.

Hereinafter, a portion in an upper surface of the odd-shaped part 1 illustrated in FIG. 8 on an outer peripheral side of the recess 5 is referred to as a peripheral portion 8. The peripheral portion 8 includes an outer peripheral side of the cutout portion 6. The cylindrical portion 2 has inner diameters in which a dimension in the lateral direction is indicated as an inner diameter R1, and a dimension in the longitudinal direction is indicated as an inner diameter R2. In this case, the inner diameter R1 is larger than the inner diameter R2. Thus, the peripheral portion 8 has the portion adjacent to the recess 5, being formed thinner than the portion adjacent to the cutout portion 6.

The odd-shaped part 1 is manufactured by applying cold forging or warm forging to the material 9 with the forging press apparatus 10. The forging press apparatus 10 includes the following: a lower device 20 provided with an insertion die 21, a molding die 22, and a lower knock-out pin 23; and an upper device 30 provided with a molding punch 31, a punch sleeve 32, a pin holder 33, and upper knock-out pins 34, as illustrated in FIG. 1. The upper device 30 moves relatively to the lower device 20 to perform press forging of the odd-shaped part 1. The present embodiment is configured such that the upper device 30 moves vertically with respect to the lower device 20.

The insertion die 21 is placed on an upper surface of the molding die 22. The insertion die 21 is provided with an upper die hole 24 into which the molding punch 31 can be inserted, the upper die hole 24 passing through vertically. The upper die hole 24 has an opening 241 provided by boring the insertion die 21. The material 9 has an end surface 91 that is exposed to the outside through the opening 241 of the upper die hole 24. The upper die hole 24 has an inner diameter that is uniform vertically. Meanwhile, the molding die 22 is provided in its upper end portion with a lower die hole 25 in a stepped shape decreasing downward in inner diameter, the lower die hole 25 passing through vertically. The lower die hole 25 has an inner diameter at its upper end that is identical to an inner diameter of the upper die hole 24 at its lower end.

The molding die 22 is also provided with a relief hole 26 that extends downward from a lower end of the lower die hole 25. The relief hole 26 has an inner diameter that is uniform vertically and is smaller than an inner diameter of the lower die hole 25 at its lower end. The relief hole 26 is formed such that the lower knock-out pin 23 can be inserted thereinto from below (a distal side when an opening 241 side is a proximal side). The lower knock-out pin 23 is positioned such that its upper end is positioned in a lower portion in the relief hole 26 except when the odd-shaped part 1 is removed. The upper die hole 24, the lower die hole 25, and the relief hole 26 communicate with each other, and constitute one through hole formed in a stepped shape as a whole.

The molding punch 31 includes a main extrusion portion 35 that shapes the recess 5 and the cutout portions 6 of the odd-shaped part 1, and a holder attachment portion 36 larger in diameter than the main extrusion portion 35. The main extrusion portion 35 includes a facing end surface (a lower end surface in the present embodiment) 311 that faces an end surface (an upper end surface in the present embodiment) 91 of the material 9. The end surface 91 of the material 9 includes a peripheral portion 911, and an inner portion 912 inside the peripheral portion 911. The molding punch 31 is configured such that the facing end surface 311 presses the inner portion 912 inside the peripheral portion 911 in the end surface 91 of the material 9. The holder attachment portion 36 of the molding punch 31 is attached and fixed to the pin holder 33. Meanwhile, the punch sleeve 32 is provided around an outer periphery of the molding punch 31, and includes a sub-extrusion portion 37 that shapes the peripheral portion 8 in the upper surface of the odd-shaped part 1, and a pin attachment portion 38 larger in diameter than the sub-extrusion portion 37. The sub-extrusion portion 37 is to be brought into contact with the peripheral portion 911 in the end surface 91 of the material 9. Pressing the inner portion 912 with the facing end surface 311 of the molding punch 31, and contact with the peripheral portion 911 with the sub-extrusion portion 37 of the punch sleeve 32, are to be performed at the same time. The pin holder 33 has an upper surface on which a pressure receiving plate 39 is disposed, and the pressure receiving plate 39 prevents the pin holder 33 and the holder attachment portion 36 from coming out upward. Each of the upper knock-out pins 34 is brought into contact at its lower end with the pin attachment portion 38. At the time of press forging of the material 9, the punch sleeve 32 moves upward by being brought into contact with the peripheral portion 911 in the end surface 91 of the material 9 in accordance with shaping with the molding punch 31. This also causes the upper knock-out pin 34 to be lifted upward. Meanwhile, to remove the odd-shaped part 1 after shaping, the forging press apparatus 10 causes the upper knock-out pin 34 to move downward to remove the odd-shaped part 1 from the molding punch 31.

Next, a method of manufacturing the odd-shaped part 1 using the forging press apparatus 10 in the present embodiment will be described. First, the material 9 is inserted into the upper die hole 24 from above so as to be loaded to about a half of depth of the lower die hole 25, in a step of loading, as illustrated in FIG. 1. At this time, a predetermined space is secured between a bottom surface of the lower die hole 25 and a lower surface of the material 9. The end surface 91 of the material 9 is positioned in a lower end portion in the upper die hole 24.

Subsequent to the step of loading, a step of forging the material 9 is performed. The step of forging is performed by cold forging or warm forging.

The molding punch 31 and the punch sleeve 32 are lowered toward the material 9 contained in the die holes 24 and 25. In an initial state of the lowering operation, the facing end surface 311 of the molding punch 31 is positioned slightly backward from a lower end surface (at an upper position) of the punch sleeve 32. Thus, while the punch sleeve 32 is to be brought into contact with the peripheral portion 911 in the end surface 91 of the material 9 earlier than the molding punch 31, the punch sleeve 32 does not cause the material 9 to be plastically deformed. That is, while being in contact with the peripheral portion 911 in the end surface 91 of the material 9, the punch sleeve 32 of the present embodiment does not press the peripheral portion 911 in the end surface 91 of the material 9 with a force causing plastic deformation thereof. As described above, the punch sleeve 32 presses the end surface 91 of the material 9 without causing plastic deformation thereof so as to prevent a part of the material 9 from creeping upward to cause occurrence of flash. The punch sleeve 32 moves upward relatively to the molding punch 31 while compressing a spring (not illustrated) such as a helical spring or a disc spring. During this period, the facing end surface 311 of the molding punch 31 is brought into contact with the inner portion 912 in the end surface 91 of the material 9 to start press forging of the material 9.

Figure 3:
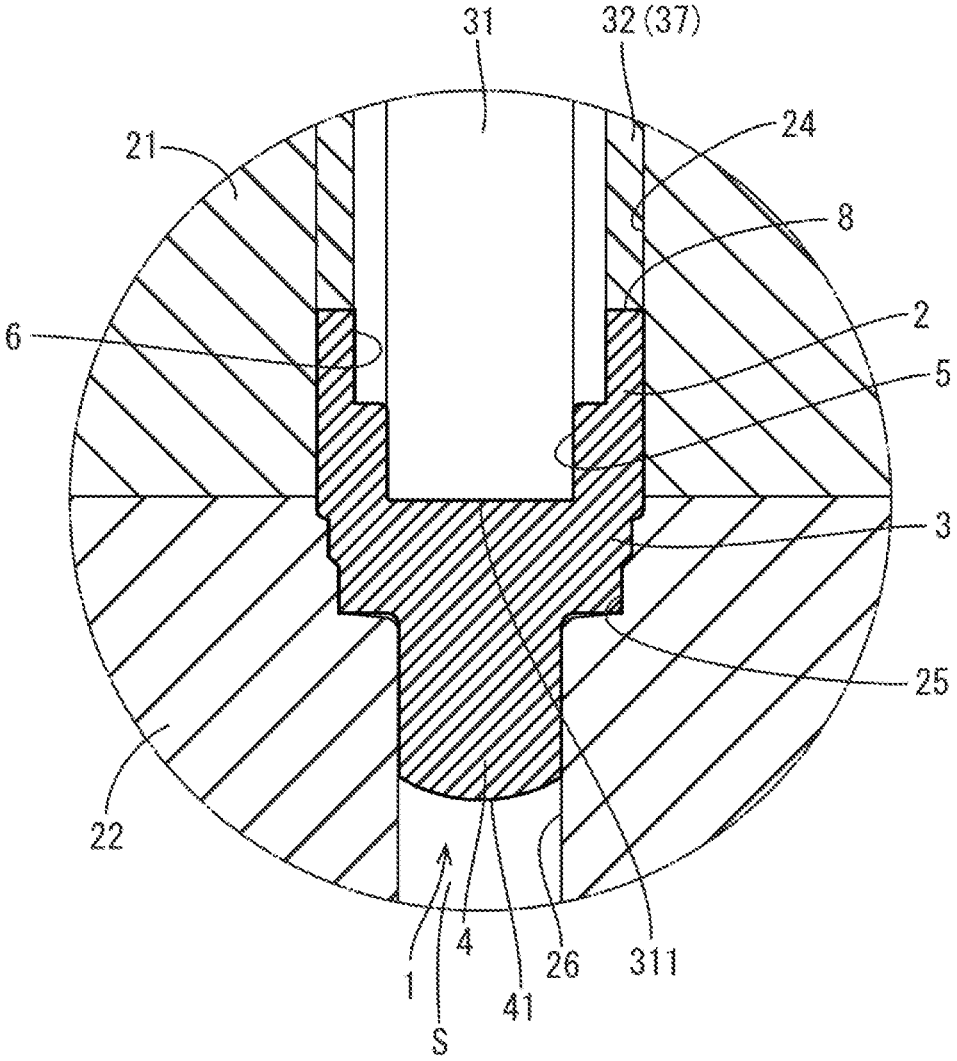
FIG. 3 is an enlarged sectional view illustrating a part of FIG. 2 in an enlarged manner.

When the molding punch 31 recesses each of the recess 5 and the cutout portion 6 to a predetermined depth after the press forging of material 9 is started, a leading end of the punch sleeve 32 (an end surface of the sub-extrusion portion 37) is brought into contact with the peripheral portion 911 in the end surface 91 of the material 9 (a product) to shape the peripheral portion 8 of the odd-shaped part 1. As illustrated in FIGS. 3 and 5, the peripheral portion 911 of the material 9 is brought into contact with the punch sleeve 32 to be shaped into the peripheral portion 8 of the odd-shaped part 1, and the inner portion 912 inside the peripheral portion 911 of the material 9 is pressed by the molding punch 31 to be shaped into the recess 5 and the cutout portion 6 of the odd-shaped part 1.

Figure 2:
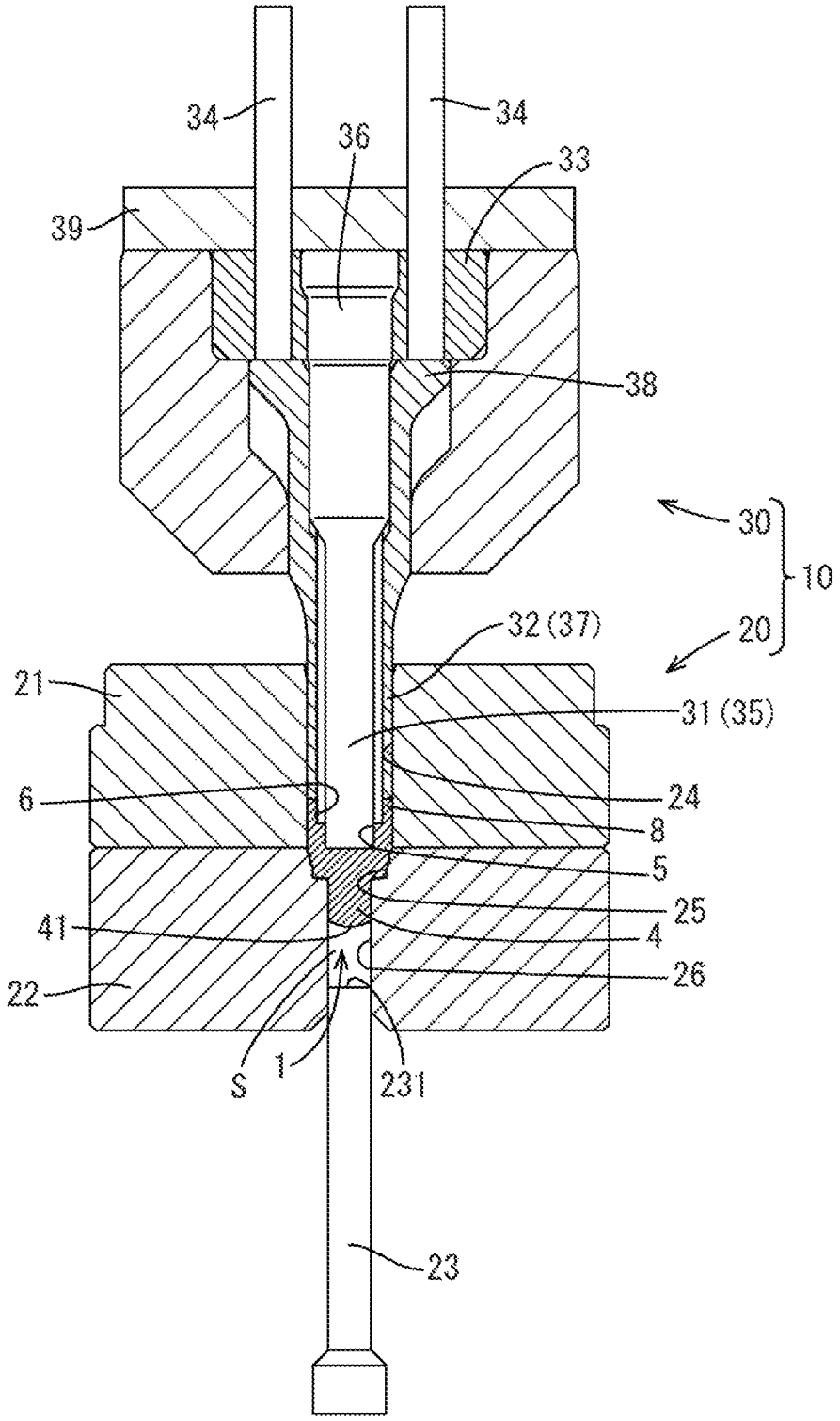
FIG. 2 is a sectional view illustrating a step of forging.
Figure 4:
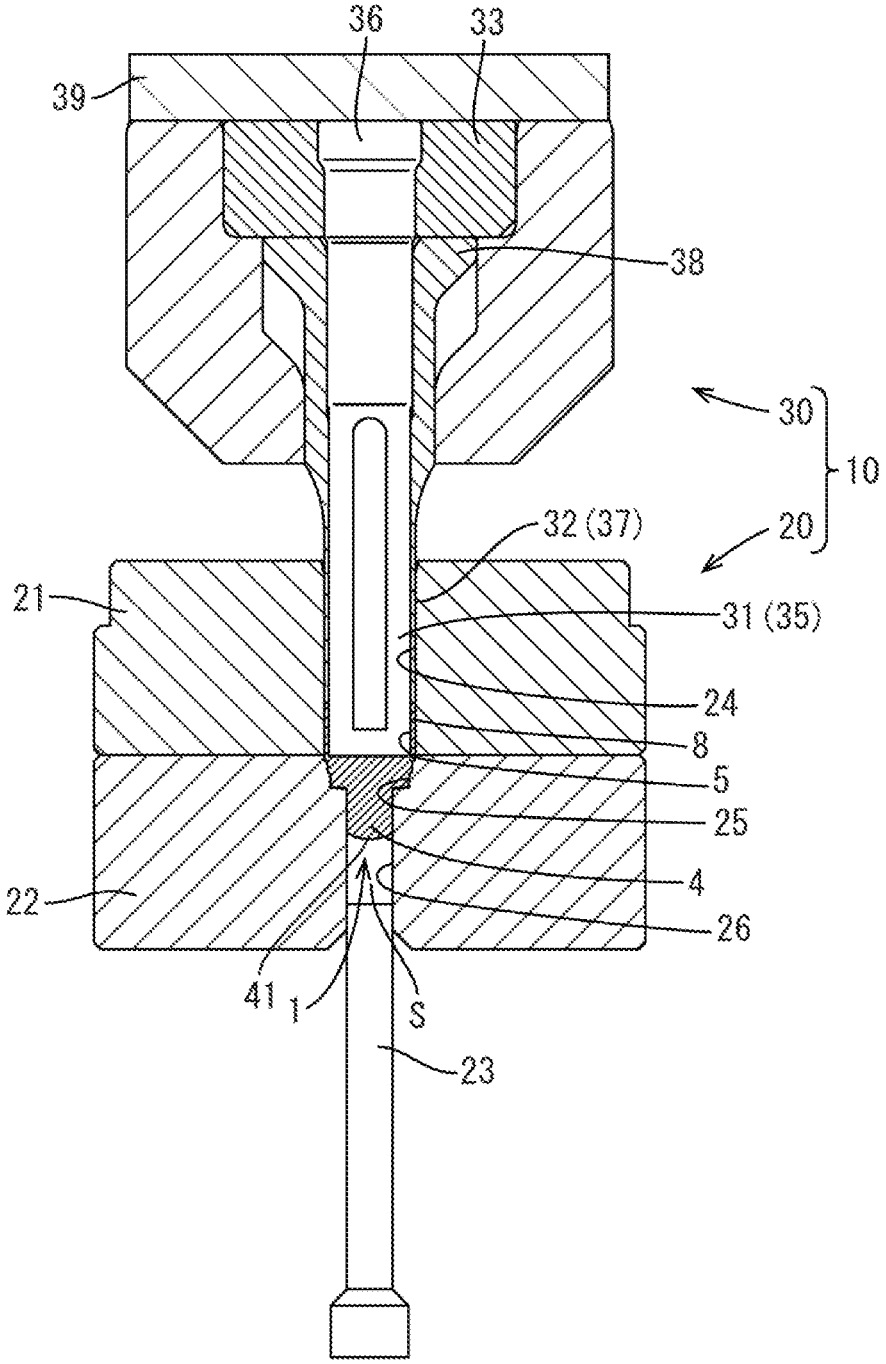
FIG. 4 is a sectional view illustrating a step of forging, taken along a cutting plane orthogonal to that of FIG. 2.

As illustrated in FIGS. 2 and 4, while a part of the material 9 flows downward through the relief hole 26 to be shaped into the projection 4, a predetermined space S is secured between a distal end (a lower end) 41 of the projection 4 and an end surface (an upper end surface) 231 of the lower knock-out pin 23. This prevents a part of the material 9 from losing a place for escape to enter a clearance between the punch sleeve 32 and the insertion die 21 to cause occurrence of flash. As a result, the peripheral portion 8 of the odd-shaped part 1 is formed in a region surrounded by the molding punch 31, the punch sleeve 32, and the insertion die 21, as illustrated in FIGS. 3 and 5. When the molding punch 31 and the punch sleeve 32 reach the bottom dead center as described above, the press forging of the material 9 is completed to form the odd-shaped part 1. At this time, both an end surface of the peripheral portion 8 and a bottom surface of the recess 5 are shaped in a plane, and thus do not need to be processed by a cutting process separately from the forging process, thereby enabling manufacturing costs to be greatly reduced.

Figure 10:
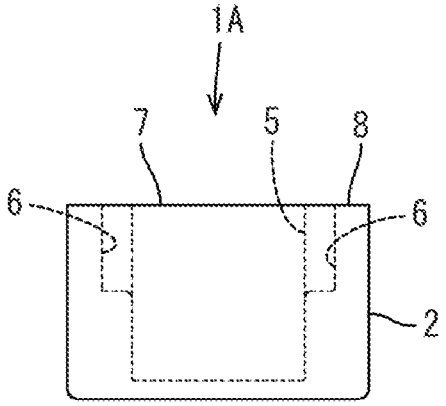
FIG. 10 is a front view of an odd-shaped part formed in a cup-like shape.

Subsequent to the step of forging, a step of removing the odd-shaped part 1 is performed. As illustrated in FIGS. 2 and 4, the recess 5 and the cutout portion 6 of the odd-shaped part 1 are fitted with a lower end portion of the molding punch 31. When the lower knock-out pin 23 is moved upward from this state, the end surface 231 of the lower knock-out pin 23 is brought into contact with the distal end 41 of the projection 4. This causes the odd-shaped part 1 to be pushed up above the insertion die 21 and the molding die 22. At the same time, or immediately after the event, the upper knock-out pin 34 is moved downward to move the punch sleeve 32 downward relatively to the molding punch 31 so that the odd-shaped part 1 is removed from the lower end portion of the molding punch 31. This causes the odd-shaped part 1 to be placed on the end surface 231 of the lower knock-out pin 23 as illustrated in FIG. 6. After this, the projection 4 is cut away through a cutting process, so that the odd-shaped part 1A illustrated in FIG. 10 is acquired.

As described above, not only pressing by the molding punch 31 but also pressing by the punch sleeve 32 is performed in the step of forging in the present embodiment, so that the peripheral portion 911 of the material 9 can be reliably pressed down by the punch sleeve 32. As a result, occurrence of flash in the peripheral portion 8 of the odd-shaped part 1 can be prevented after shaping by the molding punch 31. In addition, while a part of the material 9 is pushed out into the relief hole 26 by the molding punch 31 to form the projection 4, the space S is secured below the projection 4. As a result, even when general pressure is set higher than that for a part other than the odd-shaped part 1 (that is, an end product in a simple shape that can be formed by press forging even at low pressure), occurrence of flash due to losing a place for escape of the material 9 can be prevented.

The die hole (the upper die hole 24) is provided with the opening 241 provided by boring the die (the insertion die 21), and the end surface 91 of the material 9 may be exposed to the outside through the opening 241 of the die hole.

The molding punch 31 includes the facing end surface 311 that faces the end surface 91 of the material 9, and the facing end surface 311 may press the inner portion 912 inside the peripheral portion 911 in the end surface 91 of the material 9.

The molding punch 31 presses the inner portion 912 inside the peripheral portion 911 in the end surface 91 of the material 9, and the punch sleeve 32 is brought into contact with the peripheral portion 911 in the end surface 91 of the material 9, and then pressing by the molding punch 31 and contact by the punch sleeve 32 may be performed at the same time.

The forging press apparatus 10 includes a knock-out pin (the lower knock-out pin 23) that is inserted into the relief hole 26 of the die (the molding die 22) from a distal side, and the space S may be secured between the distal end 41 of the projection 4 and the end surface 231 of the knock-out pin in the step of forging.

This enables a hole for inserting the knock-out pin to be used as the relief hole 26, so that occurrence of flash can be prevented without a significant change in an existing die. It is a matter of course that the odd-shaped part 1 can be removed from the die by using the knock-out pin in the step of removing.

In the step of forging, the punch sleeve 32 may be inserted into the die hole to press the peripheral portion 911 in the end surface 91 of the material 9.

The structure described above enables the peripheral portion 911 of the material 9 to be shaped by the punch sleeve 32 and the die.

Other Embodiments

The technique disclosed in the present description is not limited to the embodiment described by the description and the drawings, and includes various aspects as follows, for example.

(1) While the odd-shaped part 1 provided with the cutout portion 6 is shown in the above embodiment, for example, an odd-shaped part provided with only the recess 5 may be applied. Besides, a part provided with a bottomed recess, having a circumferential wall with inconstant thickness, may be applied as an odd-shaped part, for example.

(2) While the die including the insertion die 21 and the molding die 22 is shown in the above embodiment, for example, one die formed by integrating the insertion die 21 and the molding die 22 with each other may be applied.

(3) While the lower knock-out pin 23 is inserted into the relief hole 26 from below in the above embodiment, a relief hole may be provided separately from a hole into which the lower knock-out pin 23 is inserted.

(4) While the punch sleeve 32 presses the peripheral portion 911 of the material 9 inside the insertion die 21 in the above embodiment, an upper die may be provided on the punch sleeve 32 side to press the peripheral portion 911 of the material 9 inside the upper die, or the peripheral portion 911 of the material 9 may be pressed inside the molding die 22.

(5) The sectional shape of the projection 4 is not limited to a circular shape, and may by an odd shape, such as an elliptic shape or a square shape.

(6) While in the above embodiment the recess 5 and the cutout portion 6 are processed in one step at the same time, the recess 5 and the cutout portion 6 may be processed in respective separate processes, that is, processed in two steps as a whole.

(7) While an aluminum alloy of heat treatment material is used as the material 9 in the above embodiment, an aluminum material or an aluminum alloy material may be used, or other than these metallic materials, a metallic material suitable for plastic working, such as carbon steel, low-alloy steel, copper, or copper alloy, may be used.

(8) While the odd-shaped part 1 having the peripheral portion 8 with inconstant thickness is described as an example of a cup structure in the above embodiment, a cup structure having a peripheral portion with constant thickness (a cup structure in which an outer peripheral surface and an inner peripheral surface of a peripheral portion are disposed coaxially) may be used.

(9) While the projection 4 is formed in the shape of a cylindrical column having the same outer diameter in its vertical direction in the above embodiment, a projection in a tapered shape decreasing downward in outer diameter may be applied. This causes pressure to tend to increase toward a lower portion of the projection to gradually increase a load, so that the facing end surface 311 of the molding punch 31 can easily shape the bottom surface of the recess 5 in the shape of a plane.

(10) While the press forging of the odd-shaped part 1 is performed by causing the upper device 30 to vertically move with respect to the lower device 20 in the above embodiment, the upper device 30 and the lower device 20 may be horizontally disposed side by side, and the upper device may move horizontally with respect to the lower device to perform the press forging of the odd-shaped part 1.

(11) While the punch sleeve 32 serving as a pressing member is provided separately from the molding punch 31 in the above embodiment, a portion integrated with the molding punch 31 may serve as the pressing member. That is, the punch sleeve 32 is an example of the pressing member, and a die component other than the punch sleeve 32 may be used as the pressing member.

(12) While the punch sleeve 32 pushes out the peripheral portion 911 of the odd-shaped part 1 to remove the odd-shaped part 1 from the molding punch 31 in the above embodiment, another member separate from the punch sleeve 32 may remove the odd-shaped part 1 from the molding punch 31.

The invention claimed is:

1. A method of manufacturing a cup structure by a forging press apparatus including:

a die provided with a die hole into which a material is to be contained, the material serving as a starting material of the cup structure in a bottomed cylindrical shape, and a relief hole smaller in diameter than the die hole extending downward from the die hole;

a molding punch configured to press an inner portion inside a peripheral portion of the material contained in the die hole;

a pressing member provided around an outer periphery of the molding punch to press the peripheral portion of the material;

a pressure receiving plate that is provided on the molding punch and that restricts an upward movement of the molding punch; and an upper knock-out pin that is located above the pressing member and that penetrates the pressure receiving plate, the method comprising the steps of:

loading the material into the die; and forging the cup structure shaped by pressing the inner portion inside the peripheral portion of the material with the molding punch to cause the peripheral portion of the material to be brought into contact with the pressing member, and a part of the material to be pushed out into the relief hole by the molding punch to form a projection while a space is secured below the projection, wherein the relief hole is smaller in diameter than the molding punch;

during the forging step, the pressing member moves upward relative to the molding punch while the molding punch presses the material;

during the forging step, the upper knock-out pin is configured to be moved upward by the pressing member while the upper knock-out pin penetrates the pressure receiving plate; and after the forging step, the upper knock-out pin is configured to be moved downward to move the pressing member downward relative to the molding punch.

2. The method according to claim 1, wherein the die hole includes an opening, and an end surface of the material is exposed to an outside through the opening of the die hole.

3. The method according to claim 1, wherein the molding punch includes a facing end surface facing the end surface of the material, and the facing end surface presses the inner portion inside the peripheral portion in the end surface of the material.

4. The method according to claim 1, wherein the molding punch is configured to press the inner portion inside the peripheral portion in the end surface of the material, the pressing member is configured to be brought into contact with the peripheral portion in the end surface of the material, and the pressing by the molding punch and the contact by the pressing member are performed at the same time.

5. The method according to claim 1, wherein the forging press apparatus includes a lower knock-out pin that is inserted into the relief hole of the die from a distal side, and the space is secured between a distal end of the projection and an end surface of the lower knock-out pin in the step of forging.

6. The method according to claim 1, wherein the pressing member is inserted into the die hole to press the peripheral portion in the end surface of the material in the step of forging.

7. The method according to claim 1, further comprising the step of removing the cup structure from the molding punch by causing the pressing member to push out a peripheral portion of the cup structure.

8. The method according to claim 1, wherein the cup structure includes a recess having a bottom surface in which a first dimension in a first direction is larger than a second dimension in a second direction different from the first direction, the molding punch includes a facing end surface having a shape corresponding to the bottom surface of the cup structure, and the facing end surface of the molding punch has the first dimension in the first direction and the second dimension in the second direction.

9. The method according to claim 1, wherein the cup structure includes a recess and a peripheral portion provided on an outer peripheral side of the recess, the peripheral portion of the cup structure has a first dimension on a first portion being smaller than a second dimension on a second portion, the pressing member includes an end surface having a shape corresponding to the peripheral portion of the cup structure, and the end surface of the pressing member has a first dimension in a first portion of the pressing member corresponding to the first portion of the cup structure larger than a second dimension in a second portion of the pressing member corresponding to the second portion of the cup structure.

10. The method according to claim 1, wherein the cup structure includes a recess, and a dimension of pressing with the molding punch in the pressing step is smaller than a depth of the recess of the cup structure.

11. The method according to claim 1, wherein the material includes an aluminum alloy.

12. A forging press apparatus for manufacturing a cup structure, the forging press apparatus comprising:

a die including a die hole into which a material is to be provided, the material serving as a starting material of the cup structure with a bottomed cylindrical shape, the die hole having a depth that is able to accommodate an entirety of the cup structure, and a relief hole smaller in diameter than the die hole and extending downward from the die hole;

a molding punch movable between an inside and an outside of the die hole along a first direction connecting the inside and the outside, and configured to press an inner portion inside a peripheral portion of the material contained in the die hole;

a pressing member movable along the first direction between the inside and the outside of the die hole, and provided around an outer periphery of the molding punch to press the peripheral portion of the material;

a pressure receiving plate that is provided on the molding punch and that restricts an upward movement of the molding punch; and an upper knock-out pin that is located above the pressing member and that penetrates the pressure receiving plate; wherein in a forging process of forging the material, the molding punch is configured to move inward along the first direction to apply a force to plastically deform the inner portion of the material to cause the peripheral portion of the material to be brought into contact with the pressing member, and a portion of the material to be pushed out into the relief hole by the molding punch to form a projection while a space is secured below the projection;

in the forging process of forging the material, the pressing member is configured to be movable outward along the first direction, by receiving an outward force from the peripheral portion of the material caused in response to the pressing of the inner portion by the molding punch in the forging process of forging the material, the upper knock-out pin is configured to be moved upward by the pressing member while the upper knock-out pin penetrates the pressure receiving plate; and after the forging process of forging the material, the upper knock-out pin is configured to be moved downward to move the pressing member downward relative to the molding punch.

* * * * *